US009366010B2

(12) United States Patent
Komiyama

(10) Patent No.: US 9,366,010 B2
(45) Date of Patent: Jun. 14, 2016

(54) SLEWING-TYPE WORKING MACHINE

(71) Applicant: KOBELCO CONSTRUCTION MACHINERY CO., LTD., Hiroshima-shi (JP)

(72) Inventor: Masayuki Komiyama, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/406,651

(22) PCT Filed: May 21, 2013

(86) PCT No.: PCT/JP2013/003212

§ 371 (c)(1),
(2) Date: Dec. 9, 2014

(87) PCT Pub. No.: WO2014/002368

PCT Pub. Date: Jan. 3, 2014

(65) Prior Publication Data

US 2015/0184362 A1 Jul. 2, 2015

(30) Foreign Application Priority Data

Jun. 26, 2012 (JP) ..... 2012-142845

(51) Int. Cl.
*E02F 9/12* (2006.01)
*E02F 9/20* (2006.01)
(Continued)

(52) U.S. Cl.
CPC ..... *E02F 9/123* (2013.01); *E02F 9/128* (2013.01); *E02F 9/2095* (2013.01);
(Continued)

(58) Field of Classification Search
None
See application file for complete search history.

(56) References Cited

U.S. PATENT DOCUMENTS 6,336,324 B1 * 1/2002 Schniederjan ..... E02F 9/123 60/444
2003/0061743 A1 4/2003 Tajima
(Continued)

FOREIGN PATENT DOCUMENTS

CN 102209655 A 10/2011
EP 1 298 256 A2 4/2003
(Continued)

OTHER PUBLICATIONS

Extended European Search Report issued Jul. 28, 2015 in Patent Application No. 13808817.4.
(Continued)

*Primary Examiner* — Yonel Beaulieu
*Assistant Examiner* — Krishnan Ramesh
(74) *Attorney, Agent, or Firm* — Oblon, McClelland, Maier & Neustadt, L.L.P.

(57) ABSTRACT

In a working machine having an upper slewing body rotated by a slewing electric motor, a controller outputs a command for switching a communication valve, and a command for specifying a torque of the slewing electric motor. The controller includes an abnormal-switching detection section which detects occurrence of abnormal switching in the communication valve, wherein the controller (i) determines, as a target value, a pressure which would be generated in the hydraulic motor if the communication valve was absent, or a torque determined based on the pressure, based on an operation state of a slewing operation device and a slewing state of the upper slewing body; (ii) determines, as an actual value, a pressure actually generated in the hydraulic motor or a torque determined based on the pressure; and (iii) outputs the torque command on the basis of a value obtained by subtracting the actual value from the target value.

3 Claims, 5 Drawing Sheets

(51) Int. Cl.
*E02F 9/26* (2006.01)
*E02F 9/22* (2006.01)
*F15B 20/00* (2006.01)

(52) U.S. Cl.
CPC ..... *E02F 9/2267* (2013.01); *E02F 9/267* (2013.01); *F15B 20/008* (2013.01); *F15B 2211/3058* (2013.01); *F15B 2211/6313* (2013.01); *F15B 2211/665* (2013.01); *F15B 2211/7058* (2013.01); *F15B 2211/761* (2013.01); *F15B 2211/8636* (2013.01)

(56) References Cited

U.S. PATENT DOCUMENTS

| | | | | |
|---|---|---|---|---|
| 2008/0065298 | A1* | 3/2008 | Kawaguchi | E02F 3/384 701/50 |
| 2010/0263364 | A1* | 10/2010 | Tsutsui | B66C 23/86 60/466 |
| 2011/0227512 | A1* | 9/2011 | Komiyama | B66C 23/86 318/369 |
| 2012/0259497 | A1 | 10/2012 | Yamamoto et al. | |
| 2013/0195597 | A1 | 8/2013 | Imura et al. | |
| 2013/0307443 | A1* | 11/2013 | Hirozawa | E02F 9/128 318/139 |
| 2014/0007565 | A1* | 1/2014 | Yamashita | E02F 9/128 60/431 |
| 2014/0013752 | A1* | 1/2014 | Komiyama | E02F 9/128 60/706 |
| 2014/0013753 | A1* | 1/2014 | Ueda | E02F 9/123 60/706 |
| 2014/0044514 | A1* | 2/2014 | Kamimura | E02F 9/123 414/744.2 |
| 2014/0166135 | A1* | 6/2014 | Yamashita | E02F 9/123 137/565.16 |

FOREIGN PATENT DOCUMENTS

| | | | |
|---|---|---|---|
| EP | 1 298 256 | A3 | 4/2003 |
| EP | 2 706 152 | A1 | 3/2014 |
| JP | 2003-106305 | | 4/2003 |
| JP | 2005-307587 | A | 11/2005 |
| JP | 2010-65510 | | 3/2010 |
| JP | 2010-133235 | A | 6/2010 |
| JP | 2011-144531 | A | 7/2011 |
| JP | 2012-82643 | | 4/2012 |

OTHER PUBLICATIONS

International Search Report issued Aug. 27, 2013, in PCT/JP2013/003212, filed May 21, 2013.

* cited by examiner

SLEWING-TYPE WORKING MACHINE

TECHNICAL FIELD

The present invention relates to a slewing-type working machine such as an excavator.

BACKGROUND ART

The background art of the present invention will be described with an illustration of an excavator shown in FIG. 6.

The excavator includes a crawler-type lower travel body 1, an upper slewing body 2 mounted thereon so as to be able to be slewed about the X-axis perpendicular to the ground, and an excavation attachment 3 attached to the upper slewing body 2. The excavation attachment 3 includes a boom 4 capable of being raised and lowered, an arm 5 attached to a distal end of the boom 4, a bucket 6 attached to a distal end of the arm 5, and respective hydraulic cylinders for actuating the boom 4, the arm 5, and the bucket 6, namely, a boom cylinder 7, an arm cylinder 8, and a bucket cylinder 9.

As a slew driving system for driving to slew the upper slewing body 2 of such an excavator, there is known one described in Patent Document 1. The shown slew driving system includes: a hydraulic motor for slewing, as a drive source; an electric motor connected to an output shaft of the hydraulic motor, a control valve, a communication valve, which is a solenoid switching valve provided between motor both-side lines provided on both sides of the hydraulic motor respectively and the control valve, the communication valve being capable of bringing the motor both-side lines into direct communication with each other; and an electric storage device. In the slew driving system, the communication valve is switched, upon slew braking, i.e., upon deceleration, so as to return discharged oil from the hydraulic motor to the inlet side of the hydraulic motor, and the electric motor is controlled to make a generator action for generating regenerative power generation and a regenerative brake action. The regenerative power thus generated is stored in the electric storage device.

In this system, the communication valve reduces the back pressure which acts on the motor outlet side when the slew is braked, by the direct communication between the motor both-side lines, to reduce the load of the hydraulic motor due to the involvement rotation thereof, thereby enhancing the efficiency in the recovery of the inertial motion energy, i.e., regenerative efficiency. However, in the case of abnormal switching of failing to operate the communication valve in accordance with commands due to disconnection in a control system for switching control of the communication valve or sticking of a spool or the like, various slewing troubles can be generated. For example, an occurrence where a communication valve is disabled from return from an open position to a close position prevents drive force for the hydraulic motor from being exerted and also prevents the holding force by hydraulic pressure from being exerted; this generates a risk of failing to slewing and further downward slewing due to gravity on a slope in spite that upward slewing should be performed. On contrary, an occurrence where the communication valve is disabled from being switched from the close position to the open position prevents the motor braking torque from being exerted in spite of counter operation applied to an operation member, such as a lever, for slew braking during slewing; this causes a risk of leaving a slewing body to continue inertial slewing.

Although Patent Document 1 discloses a brake valve formed of a pair of relief valves and the like, which is provided between the motor both-side lines, the brake valve is not activated during slew braking and only performs a function of keeping stop of slewing immediately after the stop thereof.

CITATION LIST

Patent Literature

Patent Document 1: Japanese Unexamined Patent Publication No. 2010-65510

SUMMARY OF INVENTION

An object of the present invention is to provide a slewing-type working machine including a hydraulic motor for slewing and a communication valve for providing communication between both-side lines on both sides of the hydraulic motor, the working machine being capable of avoiding a slewing trouble due to abnormal switching of the communication valve.

Provided by the present invention is a slewing-type working machine including: a lower travel body; an upper slewing body mounted on the lower travel body so as to be able to be slewed; a hydraulic motor which is a drive source for slewing the upper slewing body; a slewing electric motor connected to an output shaft of the hydraulic motor; a hydraulic pump which is a supply source for supplying to the hydraulic motor hydraulic oil for operating the hydraulic motor; a slewing operation device to which an operation is applied to command slew driving and slew braking of the upper slewing body; a control valve which is operated to control supply of hydraulic oil to the hydraulic motor and discharge of hydraulic oil from the hydraulic motor on the basis of the operation applied to the slewing operation device; a brake valve which is connected to motor both-side lines connected to both sides of the hydraulic motor respectively to make a hydraulic brake action; a communication valve configured to be switched between an open position for bringing a line which is one of the motor both-side lines and is connected to an outlet side of the hydraulic motor into direct communication with a tank or a line which is the other of the motor both-side lines and is connected to an inlet side of the hydraulic motor, so as to bypass the control valve, and a close position for blocking the communication; a communication-valve-switching command output section which outputs a communication-valve-switching command for switching the position of the communication valve; a torque command output section which outputs a torque command for specifying a torque of the slewing electric motor; and an abnormal-switching detection section which detects occurrence of an abnormal switching in the communication valve, wherein the torque command output section performs: (i) determining, as a target value, a pressure which would be generated in the hydraulic motor if the communication valve was absent, or a torque determined based on the pressure, based on an operation state of the slewing operation device and a slewing state of the upper slewing body; (ii) determining, as an actual value, a pressure actually generated in the hydraulic motor or a torque determined based on the pressure; and (iii) outputting the torque command on the basis of a value obtained by subtracting the actual value from the target value.

DESCRIPTION OF EMBODIMENTS

There will be described an embodiment of the present invention with reference to the drawings. This embodiment is an application of the present invention to an excavator similar to that shown in FIG. 6.

Figure 1:
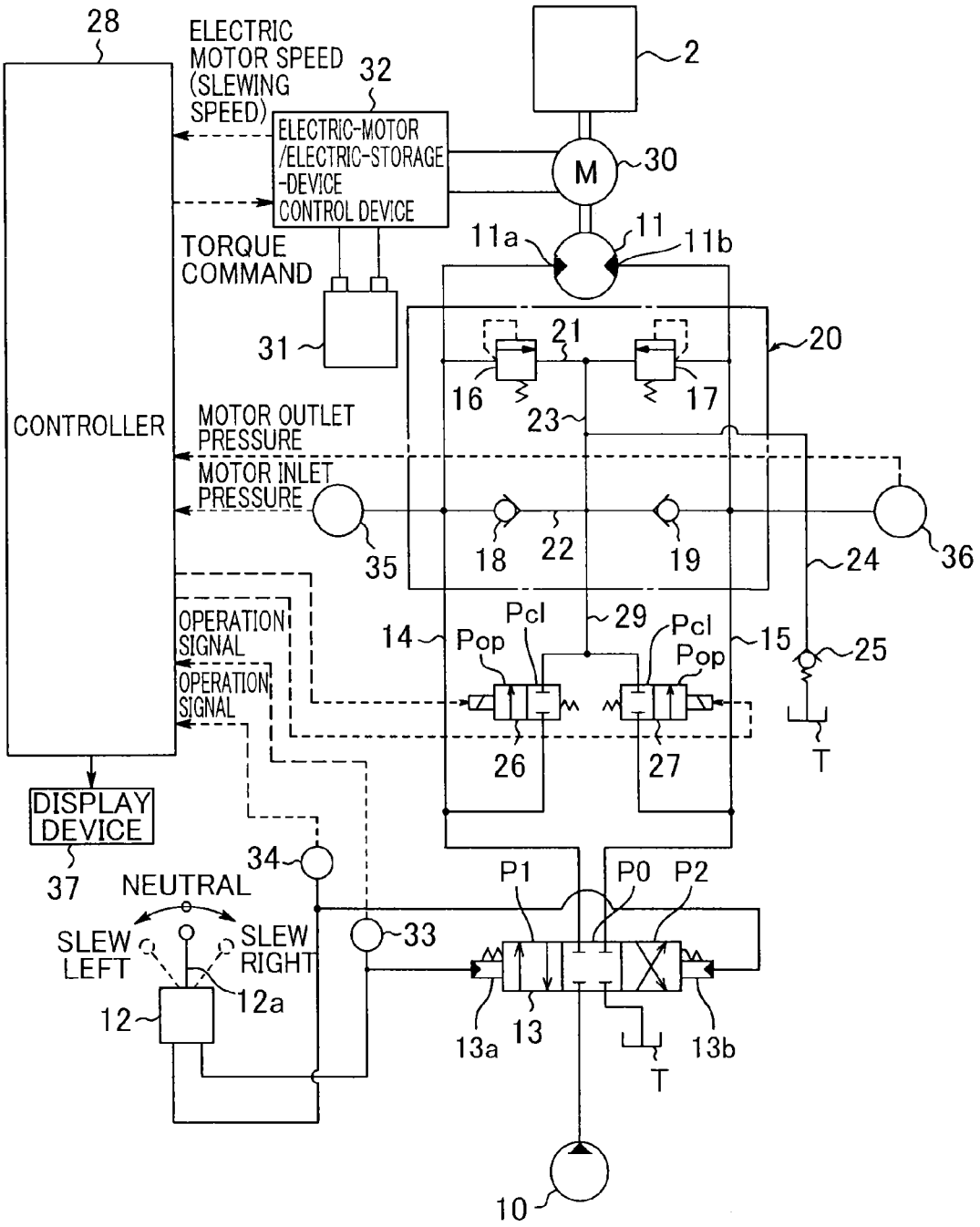
FIG. 1 is a system circuit diagram showing the configuration of a main portion of a slewing-type working machine according to an embodiment of the present invention.
Figure 6:
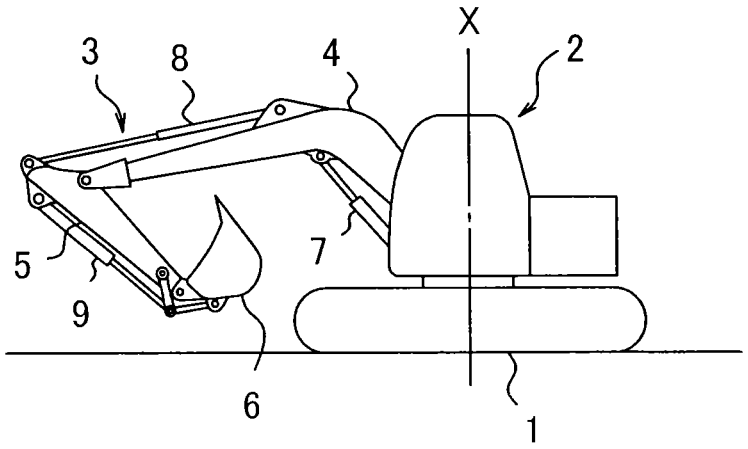
FIG. 6 is a schematic side view of an excavator which is an example of application of the present invention.

The excavator according to this embodiment includes a hydraulic pump 10, a hydraulic motor 11 for slewing, a remote control valve 12 that is a slewing operation device, and a control valve 13, shown in FIG. 1. The hydraulic pump 10 is driven by a not-graphically-shown engine to thereby function as a hydraulic pressure source which supplies hydraulic oil to the hydraulic pump 10. The hydraulic motor 11 includes ports 11*a* and 11*b*, configured to be rotated, upon supply of hydraulic oil from the hydraulic pump 10 to one of the ports, in a direction corresponding to the port receiving the supply to thereby perform slew driving of the upper slewing body 2 as shown in FIG. 6. The remote control valve 12 includes a lever 12*a*, to which an operation is applied to command slew driving and slew braking of the upper slewing body 2. The control valve 13 is provided between the hydraulic pump 10 as well as a tank T and the hydraulic motor 11 and is configured of a hydraulic-pilot-type selector valve which is operated in accordance with the operation applied to the remote control valve 12.

The lever 12*a* of the remote control valve 12 is operated between a neutral position and left and right slewing positions. The remote control valve 12 outputs a pilot pressure of a magnitude corresponding to the amount of the operation from the neutral position, from a port corresponding to the direction of the operation applied to the lever 12*a* from the neutral position.

The control valve 13 includes a pair of pilot ports 13*a* and 13*b*. When a pilot pressure is supplied to neither of the pilot ports 13*a* and 13*b*, the control valve 13 is held in a neutral position P0 to block the hydraulic motor 11 from the hydraulic pump 10. When a pilot pressure is input to the pilot port 13*a*, the control valve 13 is switched to a left slewing position P1 to connect the hydraulic pump 10 to the port 11*a* of the hydraulic motor 11. When a pilot pressure is input to the pilot port 13*b*, the control valve 13 is switched to a right slewing position P2 to connect the hydraulic pump 10 to the port 11*b* of the hydraulic motor 11. The control valve 13 is thus operated to switch between the neutral position P0 shown in the drawing and the left and right slewing position P1 or P2 by a pilot pressure from the remote control valve 12. Supply of hydraulic oil to the hydraulic motor 11 and discharge of hydraulic oil from the hydraulic motor 11 are thereby controlled, and, regarding slewing of the upper slewing body 2, controlled are respective operations of acceleration including activation thereof, steady operation at constant speed, deceleration, and stoppage as well as the slewing direction and slewing speed.

The hydraulic circuit shown in FIG. 1 includes: motor both-side lines connecting the control valve 13 and the ports 11*a* and 11*b* on both sides of the hydraulic motor 11, namely, a motor left-side line 14 and a motor right-side line 15; and a brake valve 20, which includes a pair of relief valves 16 and 17 and a pair of check valves 18 and 19 and is provided between the motor both-side lines 14 and 15. Furthermore, the hydraulic circuit includes a relief-valve circuit 21 interconnecting the relief valves 16 and 17, a check-valve circuit 22 interconnecting the check valves 18 and 19, a passage 23 interconnecting the relief valve circuit 21 and the check valve circuit 22, a makeup line 24 for hydraulic oil suctioning which connects the passage 23 to the tank T, and a back pressure valve 25 provided in the makeup line 24.

In the hydraulic circuit, when no operation is applied to the remote control valve 12, i.e., when the lever 12*a* is in the neutral position, the control valve 13 is set to the neutral position P0; when an operation is applied to the remote control valve 12, the control valve 13 is operated, by a stroke corresponding to the amount of the operation applied to the lever 12*a* of the remote control valve 12, from the neutral position P0 to the graphically shown left slewing position P1 or the right slewing position P2. In the neutral position P0, the control valve 13 blocks the two slew lines 14 and 15 from the hydraulic pump 10 to prevent the hydraulic motor 11 from rotation. When the remote control valve 12 is operated to the left or right slewing side from the state, the control valve 13 is switched to the left slewing position P1 or the right slewing position P2 to thereby permit hydraulic oil to be supplied to the port 11*a* or the port 11*b* of the hydraulic motor 11 through the left slew line 14 or the right slew line 15 from the hydraulic pump 10. The hydraulic motor 11 is thereby rotated to the left or right to drive the upper slewing body 2. The upper slewing body 2 is thus brought into an acceleration state including activation thereof or into a steady operation state at constant speed. At this time, oil discharged from the hydraulic motor 11 is returned to the tank T via the control valve 13.

On the other hand, when an operation for deceleration, i.e., an operation to a side to return to neutral position, is applied to the lever 12*a* of the remote control valve 12, for example, during right slew driving pressure is caused in the left slew line 14 on the meter-out side, and, when the caused pressure has been raised to a certain value, the brake valve 20 is activated to decelerate and stop the upper slewing body 2. Similar action is made also when deceleration stoppage is performed during left slew driving. When the motor left-side line 14 or the motor right-side line 15 is brought into negative pressure tendency during the deceleration, hydraulic oil is suctioned into the slew line 14 or 15 from the tank T in a route of the makeup line 24, the passage 23, and the check valve circuit 22, thereby preventing cavitation.

The configuration and effect thereof described above are similar to that of a slew driving system of a conventional hydraulic excavator.

Additionally to the above configuration, the hydraulic excavator according to this embodiment further includes: a left communication valve 26 and a right communication valve 27 which are provided between the respective slew lines 14, 15 and the tank T; an electric motor 30 which serves as a slewing electric motor for slewing the upper slewing body 2; an electric storage device 31; a plurality of detectors; a controller 28; and an electric-motor electric-storage-device control device 32. The controller 28 according to this embodiment includes a communication-valve-switching command output section which outputs a communication-valve-switching command for switching the position of the communication valve 26 or 27, a torque command output section which outputs a torque command for specifying the torque of the electric motor 30, and an abnormal-switching detection section which detects occurrence of an abnormal switching of the communication valve 26 or 27.

Each of the communication valves 26 and 27 is constituted by a solenoid switching valve, configured to be switched between an open position Pop and a close position Pcl by an electrical signal which is a communication-valve-switching command output by the controller 28. Each of the communication valves 26 and 27 includes an inlet port and an outlet port, configured to provide communication between the inlet port and the outlet port in the open position Pop and to block the inlet port and the outlet port in the close position Pcl. The respective inlet ports of the communication valves 26 and 27 are connected to the motor-left-side and motor-right-side lines 14 and 15, respectively, while the respective outlet ports of the communication valves 26 and 27 are connected to the passage 23 for the brake valve 20 via a passage 29. Since the passage 23 is connected to the tank T via the makeup line 24, the communication valves 26 and 27, when switched to the opening position, bring the motor-both-side lines 14 and 15 into direct communication with the tank T while bypassing the control valve 13.

The slewing electric motor 30 is connected to an output shaft of the hydraulic motor 11 and enabled to make an electric-motor action of providing the upper slewing body 2 with a slewing drive torque and a regenerative action of generating regenerative power by utilization of the slewing of the upper slewing body 2. The regenerative power generated by the regenerative action of the slewing electric motor 30 is stored in the electric storage device 31 via the electric-motor electric-storage-device control device 32.

The plurality of detectors include pressure sensors 33, 34, 35, and 36. The pressure sensors 33 and 34 detect respective pilot pressures supplied to the pilot ports 13*a* and 13*b* of the control valve 13, respectively, from the remote control valve 12, thereby functioning as slewing operation detection means for detecting the operation state of the remote control valve 12 (whether the lever 12*a* is in the neutral position or operated to the left or right slewing position). The pressure sensors 35 and 36 function as pressure detection means for detecting respective pressures in the motor both-side lines 14 and 15, i.e., respective pressures on the motor inlet side and motor outlet side at the time of slewing operation. The signal output by each of the pressure sensors 33 to 36, namely, an operation signal or a pressure signal, is input to the controller 28.

In addition, input is an information signal on the drive speed, i.e., slewing speed, of the electric motor 30 to the controller 28 from the electric-motor electric-storage-device control device 32. Alternatively, there may be provided a speed sensor which detects the speed of the slewing electric motor 30 to input the detection signal generated by speed sensor to the controller 28.

The controller 28 judges, based on each signal input thereto, whether the upper slewing body 2 is in a slewing operation state or a stopped state. When judging that it is in the slewing operation state, i.e., in an acceleration operation state including activation, or a steady operation state, or a deceleration operation state, the controller 28 always outputs a communication-valve-switching command for switching the communication valve which is one of the communication valves 26 and 27 and corresponds to the direction corresponding to the direction opposite to the direction of the operation applied to the remote control valve 12 (that is, the left-side communication valve 26 at the time of right slewing or the right-side communication valve 27 at the time of left slewing; it is hereinafter referred to as an "opposite-side communication valve") to the open position Pop. Hence, during slewing operation, oil discharged from the hydraulic motor 11 is returned to the tank T directly through a route passing through the opposite-side communication valve 26 or 27 bypassing the control valve 13. For example, during right slewing, the return to the tank T is made in a route through the hydraulic motor 11, the left slew line 14, the left-side communication valve 26, the passage 29, the passage 23, and the makeup line 24. The returned oil is thus prevented from being subject to a throttle effect in the control valve 13. This reduces the back pressure exerted on the meter-out side during slewing operation to drop the pressure on the meter-in side, thereby lowering the pump pressure; power loss of the hydraulic pump 10 is thus allowed to be reduced.

Figure 5:
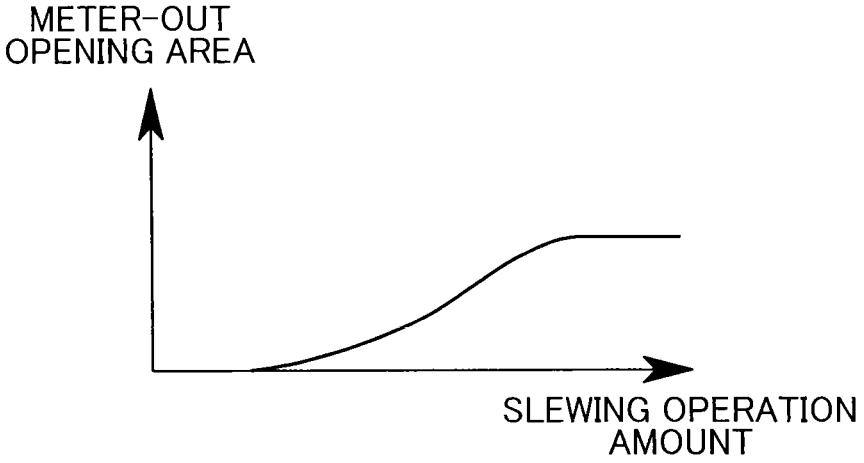
FIG. 5 is a diagram showing the relationship of the slewing operation amount and the meter-out opening area of a control valve in the case of providing no communication valve.

During the slewing operation, the electric motor 30 is driven by the hydraulic motor 11 to be brought into a so-called involvement rotation, during which the electric motor 30 makes a generator (regenerative) action based on the regenerative command from the controller 28. The regenerative action allows the electric storage device 31 to be always charged during slewing operation and allows the hydraulic motor 11 to be braked at the time of deceleration by a regenerative brake to decelerate/stop the upper slewing body 2. Following the stop of slewing, the communication valve 26 or 27 is switched to a close position b by the communication-valve-switching command from the controller 28. In this slewing stop state, the upper slewing body 2 in FIG. 5 is kept stopped by the brake action of the brake valve 20.

The controller 28 is connected with a display device 37. The controller 28 detects an occurrence of abnormal switching in the communication valve 26 or 27 due to a failure in a control system for the communication valve 26 or 27, e.g., disconnection or sticking of a spool, and, at the time of occurrence of the failure, causes display device 37 to display it to let an operator to know.

Next will be described a control operation performed by the controller 28 according to this embodiment with flowcharts in FIG. 2 to FIG. 4.

Figure 2:
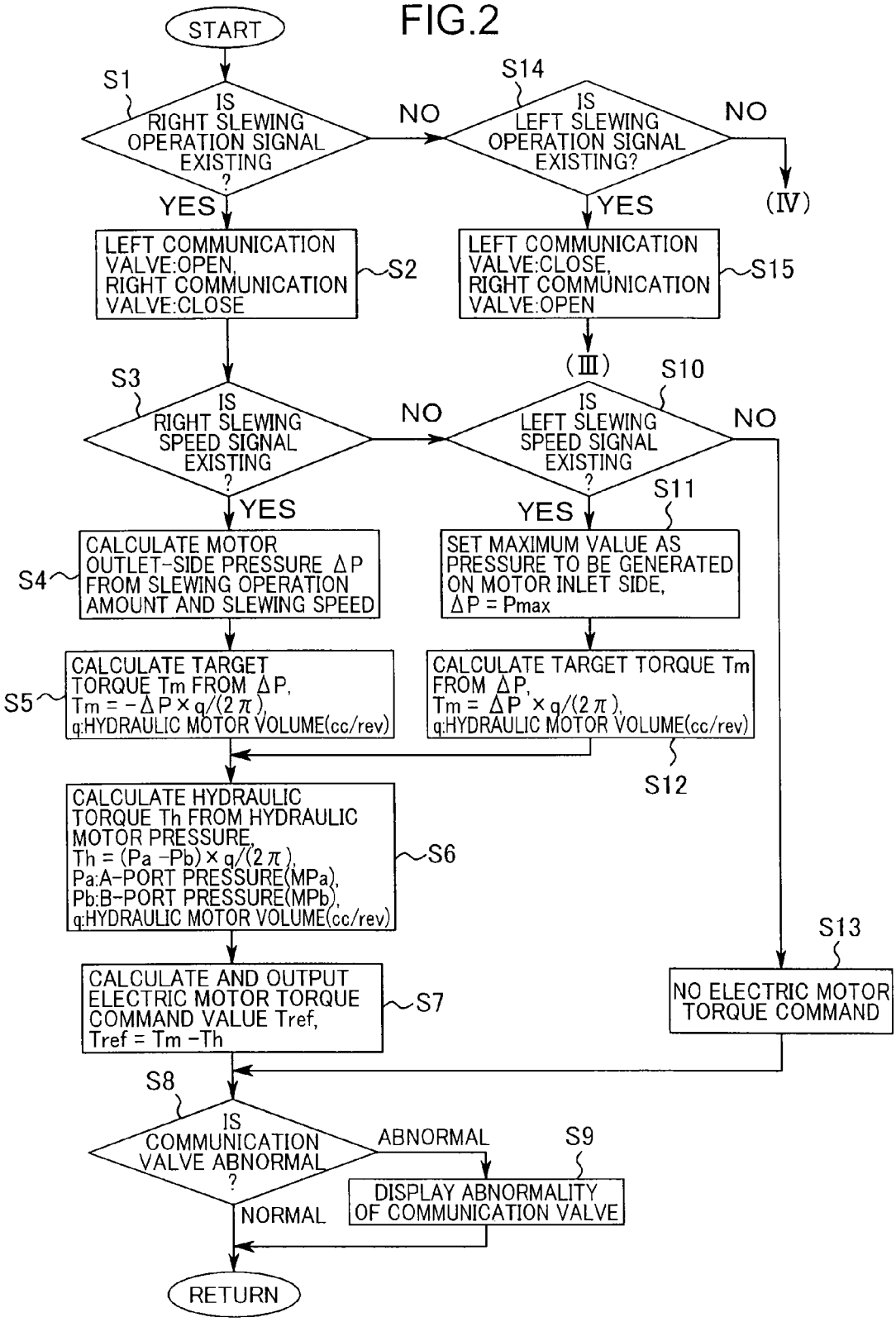
FIG. 2 is a flowchart showing the computation and control operation of a controller according to the embodiment.

In the flowchart shown in FIG. 2, following the start of control, the controller 28 judges whether or not there exists a right slewing operation signal (whether right slewing operation has been performed) in step S1; in the case of YES, the controller 28 causes the left-side communication valve 26 to be opened in step S2 (while causing the right-side communication valve 27 to be closed). In next step S3, the controller 28 judges whether or not there exists a right-slewing-speed signal (right slewing operation is being performed). In the case of YES, the controller 28 computes a command torque for the slewing electric motor 30, and outputs the torque command in steps S4 to S7.

The computation of the torque command will be described in detail. First, in step S4, the controller 28 calculates a motor outlet-side pressure ΔP in the case where the communication valves 26 and 27 were absent, based on the slewing operation amount and the slewing speed. The controller 28 stores in advance the opening characteristics, shown in FIG. 5, representing the relationship of the slewing operation amount and the meter-out opening area of the control valve 13 and calculates a meter-out opening area "A" based on the opening characteristics and the detected slewing operation amount. The controller 28 calculates, based on the detected slewing speed, a flow rate (slew flow rate) Q of hydraulic oil flowing in the hydraulic motor 11 and calculates, based on the slew flow rate Q and the calculated meter-out opening area A, the motor outlet-side pressure ΔP using the following formula (1) (step S4).

$$Q=Cd\cdot A\sqrt{(2\Delta P/\rho)} \quad (1)$$

Herein, Cd is the flow rate coefficient, and ρ is the fluid density.

Next, in step S5, the controller 28 calculates, from the calculated value ΔP of the outlet-side pressure, a target torque (target value) Tm, by use of the following formula (2).

$$Tm=-\Delta P\times q/(2\pi) \quad (2)$$

Herein, q is the hydraulic motor volume (cc/rev).

Further, in step S6, the controller 28 calculates, based on the hydraulic motor pressure, a hydraulic pressure torque (actual value) Th actually generated in the hydraulic motor 11, by use of the following formula (3).

$$Th=(Pa-Pb)\times q/(2\pi) \quad (3)$$

Herein, Pa is the pressure (MPa) of the port 11*a* of the hydraulic motor 11, and Pb is the pressure (MPa) of the port 11*b* of the hydraulic motor 11.

In step S7, the controller 28 calculates a torque Tref corresponding to the difference between the target torque Tm and the hydraulic torque Th to input the torque Tref to the electric-motor/electric-storage-device control device 32 as the torque command value for the slewing electric motor 30.

Thereafter, in step S8, the controller 28 judges whether or not there exists an abnormal switching in the communication valve 26 or 27, and returns to step S1 after causing the display device 37 to display the abnormality, if it exists, in the communication valve 26 or 27 in step S9 or directly returns to step S1, if no abnormality. The major cause of the abnormal switching is disconnection in the control system of the communication valve 26 or 27, and the disconnection can be detected by monitoring the voltage of an electrical circuit including a solenoid of the communication valve 26 or 27. Alternatively, the abnormal-switching detection section according to the present invention may include a sensor for directly detecting the switching state of the communication valve 26 or 27, e.g., stroke sensor, to judge that there exists an abnormal switching in the case of disparity between the detected switching state and the operation applied to the remote control valve 12.

In the case of NO in the above step S3, that is, in the case of no right slewing speed signal in spite of a right slewing operation, the controller 28 makes judgment on whether or not there exists a left slewing speed signal in step S10. In the case of YES, i.e., in the case where there exists a left slewing speed signal, which can be caused by a counter lever operation or downward slewing of the upper slewing body 2 due to gravity in spite of upward slewing operation, the controller 28 sets the maximum value (Pmax) corresponding to a relief pressure as the pressure ΔP which should be generated on the motor inlet side, in step S11. In the next step S12, the controller 28 calculates the target torque Tm from ΔP with use of an expression Tm=ΔP×q/(2π) and goes into step S6. Besides, in the case of NO in step S10, that is, in the case of no slewing speed signal for either right or left in spite of a right slewing operation, which can be caused by a pressing work or the like while actually making no slewing operation, the controller 28 generates no electric motor torque command in step S13 and then goes into step S8.

Figure 3:
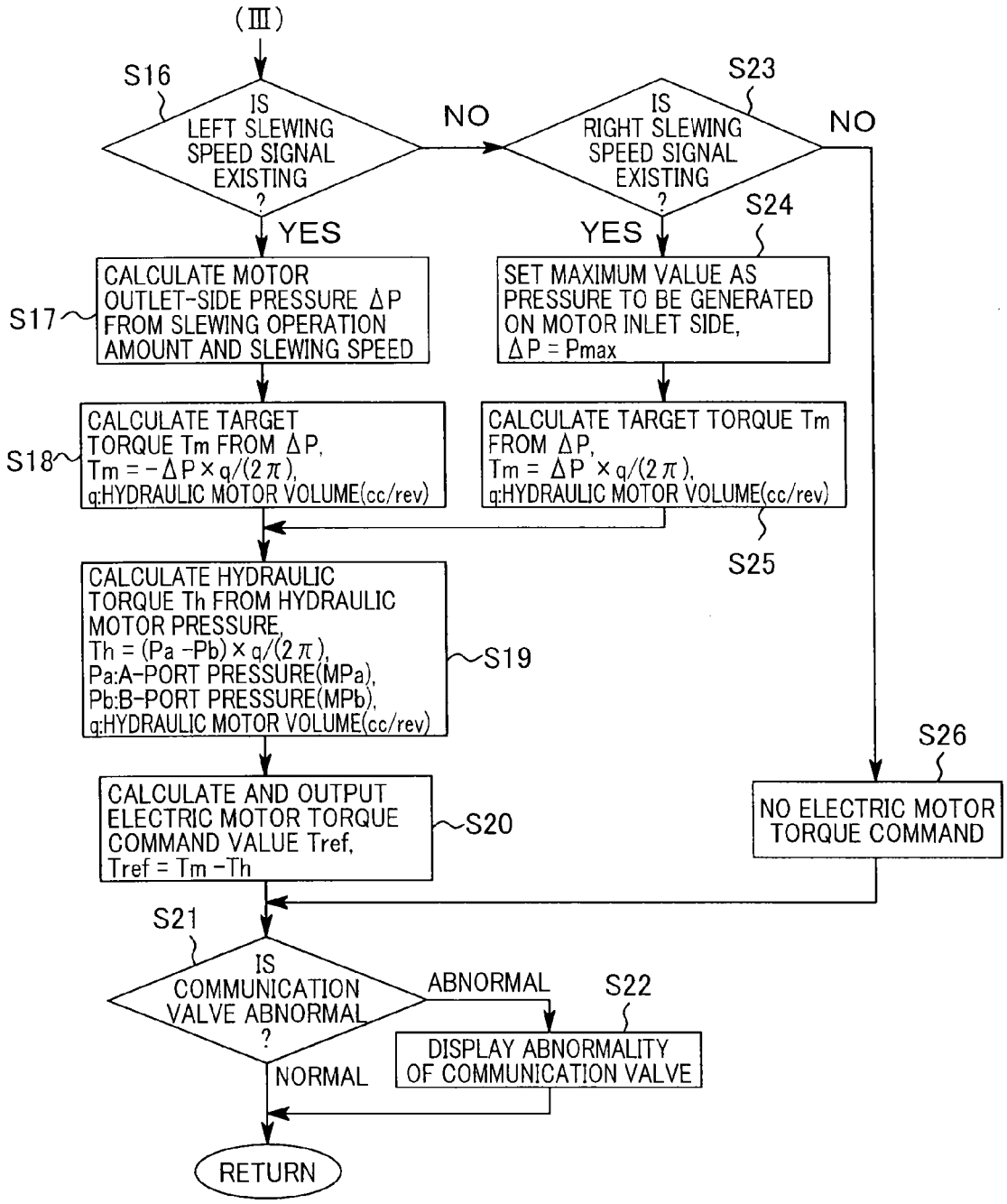
FIG. 3 is a flowchart showing the operation following (III) in FIG. 2.

In the case of NO in the above step S1, that is, in the case of no right slewing operation signal, the controller 28 makes judgment on whether or not there exists a left slewing operation signal in step S14; in the case of YES, that is, in the case where there exists a left slewing operation signal, the controller 28 causes the left-side communication valve 26 to be closed in step S15 and causes the right-side communication valve 27 to be opened, thereafter going into step S16 in FIG. 3. In the case of NO in step S14, i.e., in the case of no slewing operation signal for either right or left, the controller 28 goes into step S27 in FIG. 4.

In step S16 in FIG. 3, the controller 28 judges whether or not there exists a left slewing speed signal; in the case of YES, that is, in the case of presence of a left slewing speed signal, the controller 28 performs, similarly to steps S4 to S9 in FIG. 1, calculating the motor outlet-side pressure ΔP based on the slewing operation amount and the slewing speed (step S17), calculating the target torque Tm based on the motor outlet-side pressure ΔP (step S18), calculating the hydraulic torque Th from the hydraulic motor pressure (step S19), calculating the electric-motor-torque command value Tref and outputting it (step S20), judging an abnormality in the communication valve 26 or 27 (step S21), and displaying in the case of judging the abnormality (step S22), thereafter returning to step S1.

In the case of NO in step S16, that is, in the case of no left slewing speed in spite of a left slewing operation, the controller 28 makes judgment on whether or not there exists a right slewing speed signal in step S23. In the case of YES, the controller 28 sets the maximum value Pmax as a pressure which should be generated on the motor inlet side (ΔP=Pmax) in step S24, similarly to steps S11 to S13, in FIG. 1 and calculating the target torque Tm from ΔP with use of the expression Tm=ΔP×q/(2π), in step S25, thereafter going into step S19; in the case of NO, the controller 28 goes to step S21 with no output of electric-motor-torque command (step S26).

Figure 4:
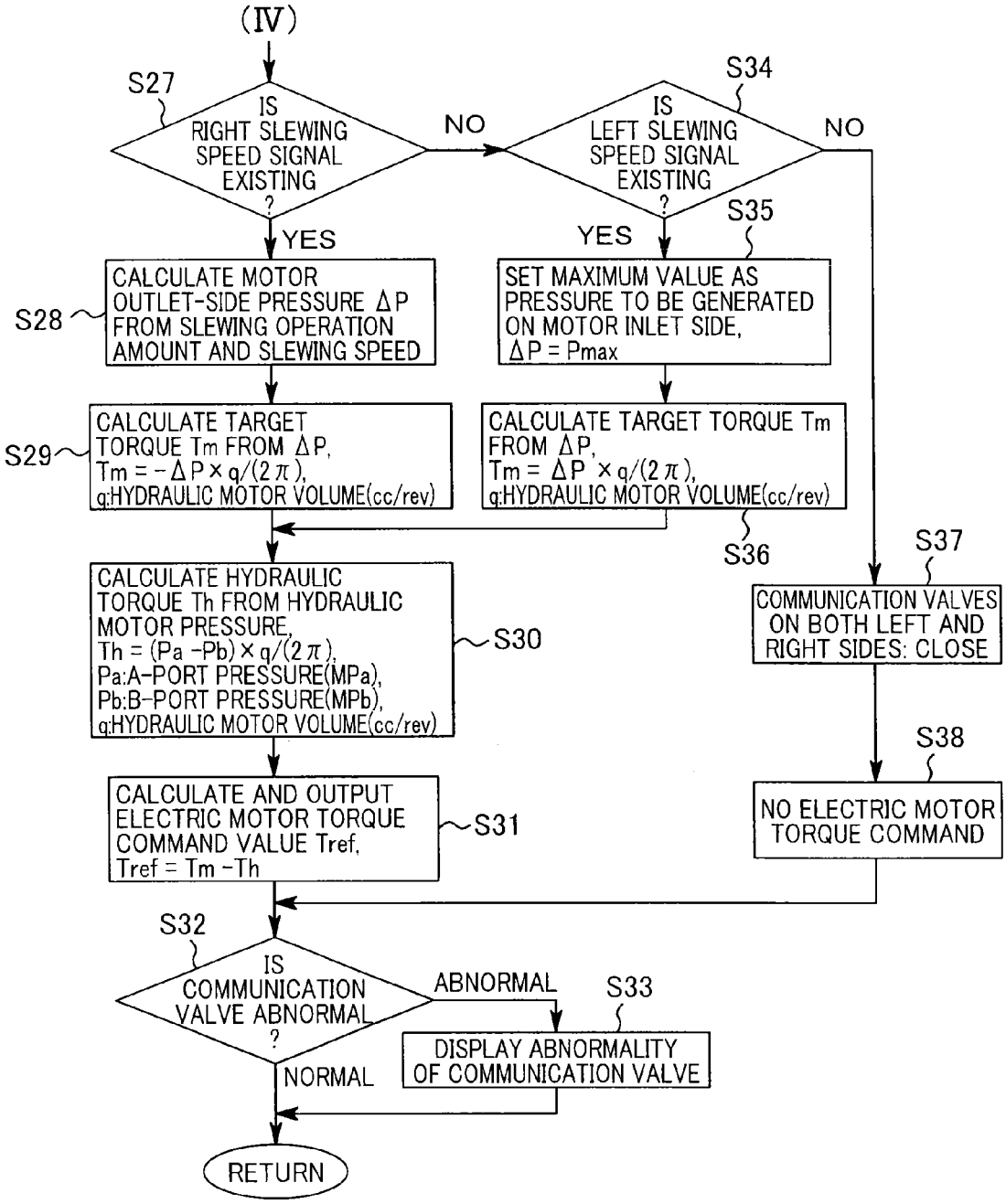
FIG. 4 is a flowchart showing the operation following (IV) in FIG. 2.

In the case of NO in step S14 in FIG. 2, i.e., in the case of none of a right slewing operation signal and a left slewing operation signal, the controller 28 determines whether or not a right slewing speed signal is existing in step S27 in FIG. 4, goes through steps S28 to S31 that are the same as steps S4 to S7 in FIG. 1 in the case of YES, i.e., in the case where a right slewing speed signal is existing, then follows steps S32 and S33 that are the same as steps S8 and S9 in FIG. 1, and returns to step S1.

In the case of NO in step S27, i.e., in the case of no right slewing speed signal exists, that is, in the case of no right slewing operation and no left slewing operation exist while no right slewing speed is caused, the controller 28 judges whether or not there exists a left slewing speed signal in step S34; in the case of YES (there exists a left slewing speed signal), which can be caused by inertial slewing of the upper slewing body 2 in spite of returning the slew remote control valve 12 to neutral for slew deceleration, the controller 28, similarly to steps S11 and S12 in FIG. 1, sets the maximum value Pmax as the pressure which should be generated on the motor inlet side in step S35, and calculates the target torque Tm from ΔP in step S36, going on to step S30. In the case of NO in step S34, that is, in the case of no left and right slewing operation signals and no speed signals, which can be caused in slewing stop state, the controller 28 causes the right and left communication valves 26 and 27 to be closed in step S37 and goes into step S32 with no output of electric motor torque command (step S38).

The controller 28, thus, inputs a torque command to the electric-motor/electric-storage-device control device 32, even in the case of occurrence of abnormal torque in the hydraulic motor 11 due to an abnormal switching of the communication valve 26 or 27, based on the value obtained by subtracting the abnormal torque from a torque which would be generated in a hydraulic motor in a normal circuit if the communication valve 26 or 27 (target value) are absent, which makes it possible to exert a torque which would be exerted if an abnormal switching was absent, on the motor output shaft, as a whole.

This enables driving or braking of the upper slewing body 2 to be performed with the same torque as in the case of no abnormality, regardless of the abnormal switching in the communication valve 26 or 27, thereby allowing a slewing trouble to be avoided. Specifically, in the case of fixing of the communication valve 26 or 27 on the outlet side to the open position Pop due to the abnormality, it is possible to generate an electric motor torque, instead of a hydraulic torque, as a braking torque, which allows the upper slewing body to be decelerated reliably, regardless of the abnormality. On the other hand, in the case of fixing of the outlet-side communication valve 26 or 27 to the close position Pcl, only an electric motor torque is exerted on the electric-motor output shaft by the torque command based on the value obtained by subtracting the hydraulic torque Th which could not be generated at normal times, which allows the electric-motor output shaft to be prevented from damage due to overload thereof.

Besides, when the slewing operation direction (commanded slewing direction) differs from the actual slewing direction, the controller 28 sets the target torque Tm based on the motor inlet-side pressure which would be generated on the inlet side of the hydraulic motor 11 if the communication valves 26 and 27 were absent, and outputs the torque Tref obtained by subtracting the actual torque Th which is the actual value actually generated in the hydraulic motor 11 from the target torque Tm, as a torque command for the slewing electric motor 30; this makes it possible to avoid a situation caused by no exertion of driving torque at the time of a counter lever operation or of upward slewing, that is, a situation of failing to drive in accordance with the operation direction against inertia, failing to brake, and further permitting the slewing driving in an operated direction cannot be performed, braking cannot be performed, and further leaving slewing yielding to gravity.

Table 1 and table 2 show respective torques generated according to the known art described in Patent Document 1 and the embodiment, in the case where the outlet-side communication valve 26 or 27 is fixed to each of the "open position" and the "close position."

TABLE 1

In the case where communication valve is fixed to "open position"

| | Normal | | Abnormal | |
|---|---|---|---|---|
| | Known art | Embodiment | Known art | Embodiment |
| Tm | — | 100 | — | 100 |
| Th | 100 | 100 | 0 | 0 |
| Tref | 0 | 0 | 0 | 100 |
| Electric-motor output shaft torque | 100 | 100 | 0 | 100 |

TABLE 2

In the case where communication valve is fixed to "close position"

| | Normal | | Abnormal | |
|---|---|---|---|---|
| | Known art | Embodiment | Known art | Embodiment |
| Tm | — | 100 | — | 100 |
| Th | 0 | 0 | 100 | 100 |
| Tref | 100 | 100 | 100 | 0 |
| Electric-motor output shaft torque | 100 | 100 | 200 | 100 |

In the case where the communication valve is fixed to the "open position" in the known art, the electric motor torque (braking torque) Tref is commanded to be 0% because of expectation that a torque would be generated by a hydraulic motor at the time of a counter lever operation or at the time of upward slewing; however, the hydraulic torque Th is also actually 0% (normally 100%), and the torque output to an electric motor output shaft is therefore 0%, as shown in Table 1. This disables an upper slewing body from being stopped even with the counter lever operation, leaving the slewing body to be downward slewed by gravity at the time of upward slew driving.

In contrast, according to the embodiment, the target torque Tm is calculated to 100% while the hydraulic torque Th is determined to 0%, which allows the determined command torque Tref to be (100-0=) 100%, thus allowing 100% of the target torque Tm to be the electric-motor output shaft torque. This allows the upper slewing body to be reliably stopped with the counter lever operation and prevents the upper slewing body from downward slewing by gravity when upward slew driving.

On the other hand, in the case where the communication valve is fixed to the "close position" in the known art, an electric motor torque is commanded to be 100%, while the hydraulic torque Th is also generated at 100% (normally 0%), which makes a total of the electric-motor output shaft torque be 200%, that is, an overload, as shown in Table 2. In contrast, according to the embodiment, 100% is calculated as the target torque Tm while the total of the electric motor command torque is calculated to 0% by subtracting 100% for the hydraulic torque, which results in the electric motor output shaft torque of 100% corresponding to the hydraulic torque, as same as the target torque. This prevents the electric-motor output shaft from overload.

Besides, the controller 28 in the embodiment, detecting an abnormal switching in the communication valve 26 or 27, can let an operator know the abnormality occurrence through display in the display device 37 or can allow the detection to be utilized in a safety measure such as stopping operation of the machine or the like.

The present invention is not limited to the above-described embodiment, while including, for example, the following embodiments.

(1) While, in the above-described embodiment, the target value and the actual value are calculated as respective torques, the target value and the actual value according to the present invention may be calculated as respective pressures. In this case, it is also permitted to determine a torque command for the slewing electric motor 30 based on a torque obtained from the difference between the respective pressures.

(2) While, in the above-described embodiment, the outlet side of the communication valves 26 and 27 is connected to the passage 23 of the brake valve 20 via the passage 29, that is, the makeup line 24 is shared as a line connecting respective outlets of the communication valves 26 and 27 to the tank T, the respective outlets of the communication valves 26 and 27 may be connected to the tank T through respective dedicated tank-connection-lines.

(3) While the communication valves 26 and 27, in the above-described embodiment, are provided for the respective motor both-side lines 14 and 15, a work machine according to the present invention may include a single communication valve shared by the both-side lines 14 and 15, the single communication valve having a close position (neutral position) and each of left and right open positions.

(4) While each of the communication valves 26 and 27 in the above-described embodiment is switched between the open position Pop for bringing the motor outlet-side line into communication with the tank T and the close position Pcl for blocking the communication, the present invention can be applied, similarly to the above, to an arrangement including a communication valve switched between an open position for bringing motor both-side lines into direct communication with each other and a close position for connecting the both-side lines to a control valve, wherein the communication valve is provided between the motor both-side lines and the control valve to bring the motor outlet-side line into communication with an inlet-side line at the time of deceleration, similarly to a direct communication switching valve described in Patent Document 1.

(5) The present invention is not limited to an excavator but is permitted to be applied, in a similar manner to the above, also to other slewing-type working machines configured based on an excavator, such as a dismantling machine or crushing machine.

As described above, the present invention provides a slewing-type working machine including a hydraulic motor for slewing and a communication valve for providing communication between both-side lines on both sides of the hydraulic motor, the working machine being capable of avoiding a slewing trouble due to abnormal switching of the communication valve. This slewing-type working machine includes: a lower travel body; an upper slewing body mounted on the lower travel body so as to be able to be slewed; a hydraulic motor which is a drive source for slewing the upper slewing body; a slewing electric motor connected to an output shaft of the hydraulic motor; a hydraulic pump which is a supply source for supplying to the hydraulic motor hydraulic oil for operating the hydraulic motor; a slewing operation device to which an operation is applied to command slew driving and slew braking of the upper slewing body; a control valve which is operated to control supply of hydraulic oil to the hydraulic motor and discharge of hydraulic oil from the hydraulic motor on the basis of the operation applied to the slewing operation device; a brake valve which is connected to motor both-side lines connected to both sides of the hydraulic motor respectively to make a hydraulic brake action; a communication valve configured to be switched between an open position for bringing a line which is one of the motor both-side lines and is connected to an outlet side of the hydraulic motor into direct communication with a tank or a line which is the other of the motor both-side lines and is connected to an inlet side of the hydraulic motor, so as to bypass the control valve, and a close position for blocking the communication; a communication-valve-switching command output section which outputs a communication-valve-switching command for switching the position of the communication valve; a torque command output section which outputs a torque command for specifying a torque of the slewing electric motor; and an abnormal-switching detection section which detects occurrence of an abnormal switching in the communication valve, wherein the torque command output section performs: (i) determining, as a target value, a pressure which would be generated in the hydraulic motor if the communication valve was absent, or a torque determined based on the pressure, based on an operation state of the slewing operation device and a slewing state of the upper slewing body; (ii) determining, as an actual value, a pressure actually generated in the hydraulic motor or a torque determined based on the pressure; and (iii) outputting the torque command on the basis of a value obtained by subtracting the actual value from the target value.

In the work machine, even in the case of occurrence of an abnormal torque of the hydraulic motor due to an abnormal switching of the communication valve, the torque command output section, providing the torque command to the electric motor based on the value of the pressure or torque (target value) which would be generated in the hydraulic motor in a circuit without the communication valve subtracted by the actual value, can exert on the motor output shaft a torque which would be exerted if the abnormal switching was absent. This makes it possible to perform driving or braking of the upper slewing body with the same torque as in the case where an abnormal is absent, regardless of the abnormal switching in the communication valve, thereby allowing a slewing trouble to be avoided. Besides, the abnormal-switching detection section, detecting an abnormal switching in the communication valve, enables the detected occurrence of the abnormality to be displayed for an operator or to be utilized in a safety measure such as stopping operation of the machine or the like.

Specifically, it is preferable that the torque command output section is configured to perform: determining a motor outlet-side pressure which would be generated on an outlet side of the hydraulic motor if the communication valve was absent, based on a meter-out opening area of the control valve determined based on an amount of the operation applied to the slewing operation device and a flow rate in the hydraulic motor; setting a target torque as the target value based on the motor outlet-side pressure; calculating, as the actual value, an actual torque actually generated in the hydraulic motor; and outputting a torque command for the slewing electric motor, on the basis of a torque obtained by subtracting the actual torque from the target torque.

This configuration enables the upper slewing body to be reliably decelerated. If the communication valve on the outlet side is fixed to the open position as one example of the abnormal switching of the communication valve, the braking torque of the hydraulic motor cannot be exerted even with a decelerating operation, and the hydraulic brake force of the brake valve also cannot be exerted, which may cause braking during work on flat ground work to be impossible; however, the torque command output section which determines the command torque as described above can generate the electric motor torque instead of the hydraulic torque as the braking torque, thus enabling the upper slewing body to be decelerated reliably. Besides, if the outlet-side communication valve is fixed to the close position, both of the electric motor regenerative torque and the hydraulic braking torque due to the hydraulic brake can exert on the electric motor output shaft, which may subject the electric motor output shaft to overload; however, the torque command output section which determines the command torque as described above can exert on the electric motor output shaft only the electric motor torque by subtracting the hydraulic torque which could not be generated in normal state from the target torque, thereby preventing the electric motor output shaft from a sudden deceleration shock or damage.

The torque command output section is preferably configured to perform, when a slewing direction commanded by the slewing operation device differs from an actual slewing direction, setting a target torque which is the target value based on a motor inlet-side pressure which would be generated on an inlet side of the hydraulic motor if the communication valve was absent, calculating, as the actual value, an actual torque actually generated in the hydraulic motor from the motor inlet-side pressure and a motor outlet-side pressure, and outputting, as a torque command for the slewing electric motor, a torque obtained by subtracting the actual torque from the target torque. The torque command output section makes it possible to avoid occurrence of a situation caused by impossibility of exertion of a drive torque at the time of a counter lever operation or at the time of upward slewing, that is, a situation of impossibility of driving, against inertia, in the direction corresponding to the operation direction, impossibility of braking and allowance of slewing yielding to gravity.

The invention claimed is:

1. A slewing-type working machine comprising:

a lower travel body;

an upper slewing body mounted on the lower travel body so as to be able to be slewed;

a hydraulic motor which is a drive source for slewing the upper slewing body;

a slewing electric motor connected to an output shaft of the hydraulic motor to generate regenerative power by utilization of the slewing of the upper slewing body;

a hydraulic pump which is a supply source for supplying to the hydraulic motor hydraulic oil for operating the hydraulic motor;

a slewing operation device to which an operation is applied to command slew driving and slew braking of the upper slewing body;

a control valve which is operated to control supply of hydraulic oil to the hydraulic motor and discharge of hydraulic oil from the hydraulic motor on the basis of the operation applied to the slewing operation device;

a brake valve which is connected to motor both-side lines connected to both sides of the hydraulic motor respectively to make a hydraulic brake action;

a communication valve configured to be switched between an open position in which the communication valve brings a line which is one of the motor both-side lines and is connected to an outlet side of the hydraulic motor into direct communication with a tank or a line which is the other of the motor both-side lines and is connected to an inlet side of the hydraulic motor, so as to bypass the control valve, and a close position in which the control valve blocks the communication;

a controller which outputs a communication-valve-switching command for switching the position of the communication valve, and a torque command for specifying a torque of the slewing electric motor and inputs the torque command into the slewing electric motor, wherein the controller includes an abnormal-switching detection section which detects occurrence of an abnormal switching in the communication valve and the controller performs:

(i) determining, as a target value, a pressure which would be generated in the hydraulic motor in case the communication valve was absent, or a torque determined based on the pressure, based on an operation state of the slewing operation device and a slewing state of the upper slewing body;

(ii) determining, as an actual value, a pressure actually generated in the hydraulic motor or a torque determined based on the pressure; and (iii) outputting the torque command on the basis of a value obtained by subtracting the actual value from the target value.

2. The slewing-type working machine according to claim 1, wherein the controller determines a motor outlet-side pressure which would be generated on an outlet side of the hydraulic motor if the communication valve was absent, based on a meter-out opening area of the control valve determined based on an amount of the operation applied to the slewing operation device and a flow rate in the hydraulic motor;

setting a target torque as the target value based on the motor outlet-side pressure;

calculating, as the actual value, an actual torque actually generated in the hydraulic motor; and outputting a torque command for the slewing electric motor, on the basis of a torque obtained by subtracting the actual torque from the target torque.

3. The slewing-type working machine according to claim 1, wherein the controller performs, at a time that a slewing direction commanded by the slewing operation device differs from an actual slewing direction, setting a target torque which is the target value based on a motor inlet-side pressure which would be generated on an inlet side of the hydraulic motor in case the communication valve was absent, calculating, as the actual value, an actual torque actually generated in the hydraulic motor from the motor inlet-side pressure and a motor outlet-side pressure, and outputting, as a torque command for the slewing electric motor, a torque obtained by subtracting the actual torque from the target torque.

* * * * *